US009768548B2

(12) United States Patent
Pegel et al.

(10) Patent No.: US 9,768,548 B2
(45) Date of Patent: Sep. 19, 2017

(54) MULTICORE CABLE AND METHOD FOR MANUFACTURING THE SAME

(71) Applicant: MD Elektronik GmbH, Waldkraiburg (DE)

(72) Inventors: Lenka Pegel, Buchbach (DE); Ralph Freudenstein, Muehldorf (DE); Alexander Wald, Tittmoning (DE); Klaus Bramhofer, Tuessling (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 202 days.

(21) Appl. No.: 14/724,838

(22) Filed: May 29, 2015

(65) Prior Publication Data

US 2015/0349456 A1 Dec. 3, 2015

(30) Foreign Application Priority Data

May 30, 2014 (EP) ..... 14001887

(51) Int. Cl.

| | |
|---|---|
| ***H01R 13/58*** | (2006.01) |
| ***H01R 4/18*** | (2006.01) |
| ***H01R 43/048*** | (2006.01) |
| *H01R 13/6592* | (2011.01) |

(52) U.S. Cl.

CPC ..... *H01R 13/5812* (2013.01); *H01R 4/18* (2013.01); *H01R 13/5845* (2013.01); *H01R 43/048* (2013.01); *H01R 13/6592* (2013.01); *Y10T 29/49176* (2015.01); *Y10T 29/49187* (2015.01)

(58) Field of Classification Search

CPC ..... Y10T 29/49176; Y10T 29/49187; H01R 13/5845; H01R 43/048; H01R 13/5812; H01R 4/18; H01R 13/6592

USPC ..... 439/460, 854–855, 881; 29/863, 857

See application file for complete search history.

(56) References Cited

U.S. PATENT DOCUMENTS

| | | | | |
|---|---|---|---|---|
| 4,838,808 | A * | 6/1989 | Fujiura | H01R 13/6275 439/347 |
| 6,506,075 | B2 * | 1/2003 | Chiran | H01R 13/506 439/607.01 |
| 6,951,475 | B2 * | 10/2005 | Silva | H01R 12/7064 439/449 |
| 2001/0049225 | A1 | 12/2001 | Chiran et al. | |
| 2003/0139095 | A1 | 7/2003 | Yang Lee | |
| 2005/0272313 | A1 | 12/2005 | Ichikawa et al. | |

FOREIGN PATENT DOCUMENTS

| | | | |
|---|---|---|---|
| DE | 4013509 | A1 | 10/1991 |

* cited by examiner

*Primary Examiner* — Edwin A. Leon
(74) *Attorney, Agent, or Firm* — Leydig, Voit & Mayer, Ltd.

(57) ABSTRACT

A cable includes an electric line having a plurality of cores with contacts being attached to ends of the cores. A plug connector has a contact carrier which accommodates the contacts in such a manner that the contacts are disposed in the contact carrier with a directional component that is oriented in parallel to a first direction. A collar is integrally formed on the contact carrier. The collar fixes the electrical line in position and bends the cores such that the cores have a directional component that is oriented in parallel to a second direction. The first direction is orthogonal to the second direction.

12 Claims, 4 Drawing Sheets

MULTICORE CABLE AND METHOD FOR MANUFACTURING THE SAME

CROSS-REFERENCE TO PRIOR APPLICATION

Priority is claimed to European Patent Application No. EP 14 001 887.0, filed on May 30, 2014, the entire disclosure of which is hereby incorporated by reference herein.

FIELD

The present invention relates to a prefabricated cable that includes a plug connector, in particular, respectively a coupling element for transmitting electrical currents or voltages, as well as to a method for manufacturing such a cable. The cables in question are used in motor vehicles or aircraft, for instance, and are mostly needed in large quantities. A simple design and ease of assembly are recognized by the inventors as being important for providing such cables inexpensively. A high process reliability and a high level of precision, to provide a high-quality transmission of measurement signals, for example, are entailed in the manufacturing of such cables. The cables must also meet stringent demands in terms of ruggedness, in particular in terms of imperviousness to water or other liquids.

BACKGROUND

A multicore cable having an angle-entry plug is known the German Patent Application DE 40 13 509 A1, from Example 2 presented therein, thus from FIG. 6 through 9 and the corresponding description. That publication discusses a method that ensures an exact dimensioning and maintaining of spacing of the embedded contact blades. The disadvantage, inter alia, of the design in accordance with the German Patent Application DE 40 13 509 A1 is that it is relatively complex to manufacture such a cable.

SUMMARY OF THE INVENTION

In an embodiment, the present invention provides a cable including an electric line having a plurality of cores, with contacts being attached to ends of the cores. A plug connector has a contact carrier which accommodates the contacts in such a manner that the contacts are disposed in the contact carrier with a directional component that is oriented in parallel to a first direction. A collar is integrally formed on the contact carrier. The collar fixes the electrical line in position and bends the cores such that the cores have a directional component that is oriented in parallel to a second direction. The first direction is orthogonal to the second direction.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
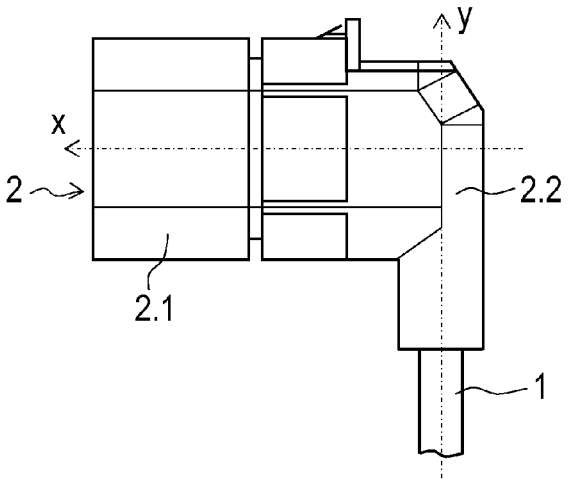
FIG. 1 shows a side view of a cable.

In an embodiment, the present invention provides a cable that is high-grade and, nevertheless, relatively simple to manufacture.

In another embodiment, a manufacturing method is provided that makes it possible for high-grade cables to be produced with relatively little outlay.

In accordance with an embodiment of the present invention, the cable includes an electric line and a plug connector, the electric line having a plurality of cores, and the plug connector having a contact carrier. In addition, each end of a core has a contact attached thereto. The contact carrier accommodates the contacts in a way that allows them to be configured therein with a directional component that is oriented in parallel to a first direction. Integrally formed on the contact carrier is a collar, the electric line being fixed in position by the collar. The collar is designed, and the electric line is fixed in position thereon, in a way that allows the collar to bend the cores with a directional component that is oriented in parallel to a second direction, the first direction being oriented orthogonally to the second direction.

Therefore, in the area of the collar, the cores may be bent by the collar in a way that orients them orthogonally to the contacts in the contact carrier.

During the manufacturing process, in particular, the collar serves as a holder that retains the electric line with positional accuracy.

The contacts are electrically conductive end portions of the cores, respectively end portions of the conductors, and may be configured as pins or as socket connectors.

The contact carrier advantageously has bushings, the bushings being inwardly configured in the contact carrier and oriented in parallel to the first direction. Accordingly, the contacts are accommodated in the bushings in a way that allows them to be configured in the contact carrier with a directional component that is oriented in parallel to the first direction.

One advantageous type of construction provides that the cable be configured in a way that allows the plug connector to have an extrusion coating, and the cores to be at least partially surrounded by the same. The term "partially" refers, in particular, to the length of the cores, so that the cores are, therefore, completely surrounded by the extrusion coating, at least over a longitudinal section. In addition, the collar may be at least partially surrounded by the extrusion coating.

In a further embodiment of the present invention, the electric line includes an insulating sheath that is removed at the end thereof. The plug connector has an extrusion coating, the cores being surrounded by the extrusion coating (in particular, completely) over a length along which the sheath is removed, thus in the stripped area of the electric line.

In addition, in one partial length (of the sheath, respectively of the electric line), the sheath may be surrounded by the extrusion coating.

The configuration of the cable may be such that, over the length along which the sheath is removed, the cores are bent by approximately 90° and are surrounded by the extrusion coating (in particular, completely) in this bent region.

The electric line advantageously has an insulating sheath, the sheath being fixed in position at the collar, in particular by clamping. Thus, the collar may be configured to clampingly fix the electric line, in particular the sheath, in position on the contact carrier.

In one advantageous type of construction, the electric line includes an insulating sheath, and the collar features a limit stop against which the sheath rests on the end face side. Accordingly, the sheath has an end face, for example a cross-sectional area that rests against the limit stop of the collar, it being possible for the end face to be produced by the preceding stripping of the end of the electric line.

The cores advantageously have different lengths. In addition, the cable may have cores whose conductors have different cross-sectional areas. This type of construction may be used, in particular when the cable is not only designed for transmitting signals, for example analog measurement signals, but also for transmitting electrical energy, respectively electric power as well. Those cores, which are designed for transmitting electrical energy, often have a larger cross sectional area.

In certain embodiments, the cable may have an unshielded configuration.

In a further embodiment of the present invention, the contacts are connected to the cores by a crimping.

In another embodiment, the present invention provides a method for manufacturing a cable having a plug connector that includes the following steps: providing an electric line having a plurality of cores and subsequently attaching each contact to a core end, respectively subsequently attaching contacts to core ends;

inserting the contacts into a contact carrier, in particular into the bushings thereof, thereby accommodating the contacts in the contact carrier with a directional component that is oriented in parallel to a first direction;

securing the electric line to a collar, that is integrally formed on the contact carrier, in such a way that the collar bends the cores with a directional component that is oriented in parallel to a second direction, the first direction being oriented orthogonally to the second direction; and extrusion coating of the cores, thereby allowing them to be at least partially surrounded by the extrusion coating.

Another embodiment of the method provides that the extrusion coating be implemented in such a way that the collar is at least partially surrounded by the same. The collar is advantageously completely surrounded by the extrusion coating.

One advantageous refinement of the method provides that the electric line include an insulating sheath that is usually removed at one end thereof, the collar featuring a limit stop on which the sheath is fixed in position so as to rest by the end face thereof against the collar. The sheath is typically removed in that a circumferentially extending cut is initially made into the sheath along a circular line whose center point comes to lie on the longitudinal axis of the electric line. The circular line delimits a circular surface through which the longitudinal axis extends orthogonally. The cut does not necessarily have to extend completely circumferentially around. For example, two V-shaped blades may also penetrate radially into the sheath, so that no completely 360° circumferentially extending cut, respectively incision is, therefore, made into the sheath. Following the cutting, respectively incising, the section of the sheath is then pulled off of the electric line, so that an essentially annular end face is formed on the sheath that may act as a contact face at the stop surface of the collar.

A crimping process is advantageously used to fasten the contacts at the ends of the cores.

In a further embodiment of the method, the electric line includes an insulating sheath, thereby producing an end face-side sheath surface that is used as a reference for the cutting-to-length of the cores. The end in question of the electric line is stripped prior to this step, in particular.

In one advantageous refinement of the method, the cores are cut to different lengths.

Other details and advantages of the cable according to the present invention, respectively of the manufacturing method according to the present invention are derived from the following description of an exemplary embodiment, which makes reference to the accompanying figures.

FIG. 1 shows a cable for transmitting electrical energy and signals, for instance for transmitting measurement information, that is designed, in particular, for installation in a vehicle. In accordance with the exemplary embodiment, the cable may have an unshielded configuration.

In accordance with FIG. 1, the cable includes an electric line 1 that is only partially shown in the figure, and a plug connector 2, respectively a coupling element, allowing the cable to be detachably connected in the sense of a plug-in connection via plug connector 2 at one end to a corresponding counterpart of another component, for example an element of an on-board electronics. A coupling element may likewise be provided at the other end of the cable. Plug connector 2 includes a contact carrier 2.1 and an extrusion coating 2.2. Extrusion coating 2.2 is a component of plug connector 2 that is produced by extrusion coating plastic material around contact carrier 2.1 and a portion of electric line 1. A hermetically sealed variant of the cable may be readily achieved at the end thereof, respectively in the area of plug connector 2.

Figure 2:
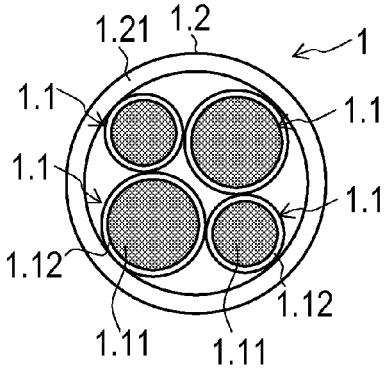
FIG. 2 shows an end face view of an electric line in a state during the prefabrication process.

FIG. 2 shows a view of an end face of electric line 1 in a state during the prefabrication process. In the exemplary embodiment presented here, electric line 1 has four cores 1.1. Cores 1.1 each encompass a conductor 1.11, for example in the form of a plurality of individual wires that are surrounded by an insulation layer 1.12. Accordingly, in the exemplary embodiment presented here, cores 1.1 may also be referred to as stranded conductors. In the exemplary embodiment, conductors 1.11 have two different cross-sectional areas; that pair of cores 1.1 having the smaller cross-sectional area being designed for transmitting signals, while the other pair having the larger cross-sectional area being designed for transmitting electrical energy. In addition, electric line 1 includes an insulating sheath 1.2 that encircles cores 1.1.

In the course of manufacturing of the cable, sheath 1.2 is first incised at the end of electric line 1 along a circumferential line and, subsequently thereto, pulled off, respectively removed. Therefore, an end face-side, annular cut surface 1.21 is present at the end of sheath 1.2 in accordance with FIGS. 2 and 3.

End face-side surface 1.21 serves as a stop face for cutting cores 1.1 to length. These were cut into two different lengths a4, a2, starting from end face-side surface 1.21. Insulation layers 1.12 were subsequently incised along a circumferential line and removed in this end region. The cutting lines in insulation layers 1.12 feature a distance a3, respectively a1 from surface 1.21.

Figure 4:
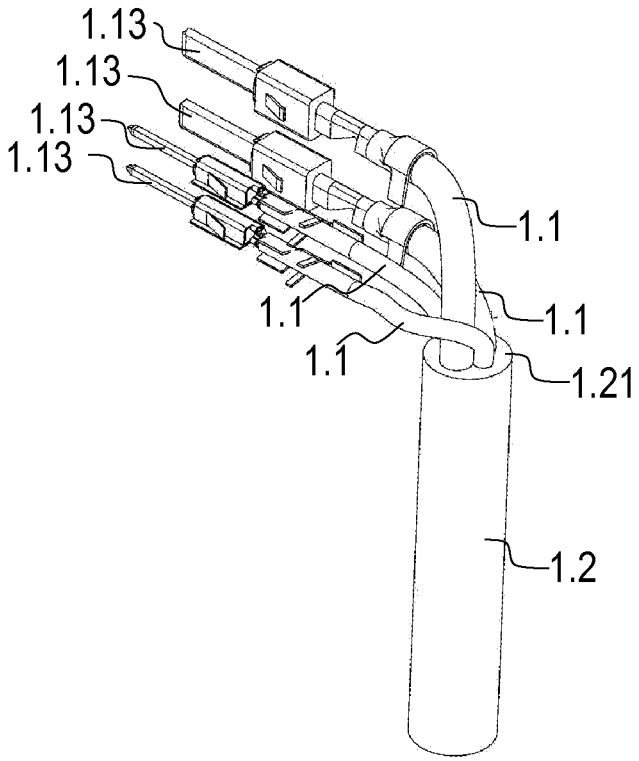
FIG. 4 shows a perspective view of the electric line including contacts in a state during the prefabrication process.

Contacts 1.13 are then attached to the thus prepared electric line 1. A crimping process secures a contact 1.13 to the stripped ends of cores 1.1 in particular, respectively to conductors 1.11. Accordingly, an electric line 1 having contacts 1.13 is then provided at conductors 1.11 in accordance with FIG. 4. This FIG. 4 shows cores 1.1 in the installed state of electric line 1, bent by 90°, in accordance with the conventional orientation.

Figure 5:
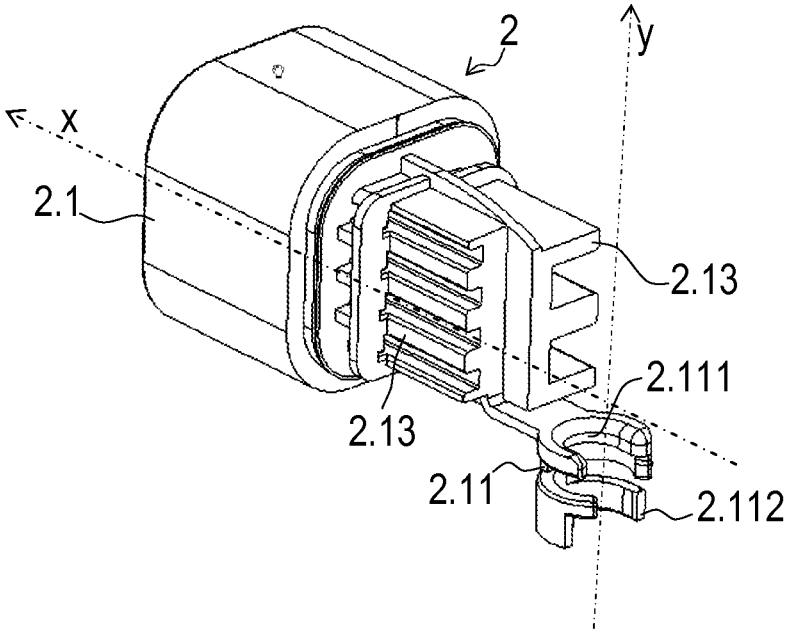
FIG. 5 shows a perspective view of a contact carrier.
Figure 6:
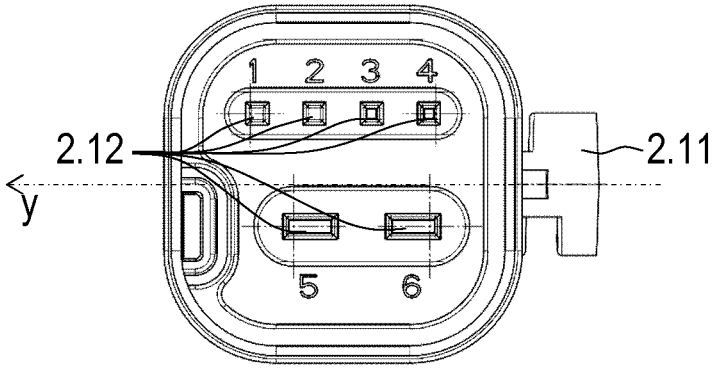
FIG. 6 shows a front view of the contact carrier.
Figure 7:
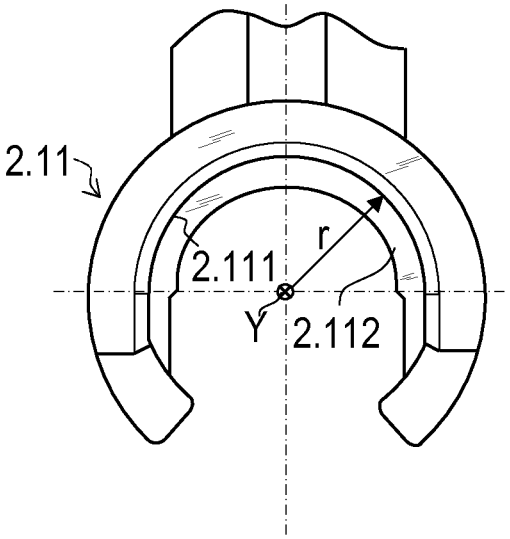
FIG. 7 shows a detailed view of a collar of the contact carrier.

FIGS. 5, 6 and 7 show dielectric contact carrier 2.1 that is configured as an injection-molded part. Contact carrier 2.1 includes a plurality of bushings 2.12 that are discernible in FIG. 6 in a frontal view of contact carrier 2.1. In the present case, contact carrier 2.1 features six bushings 2.12; in the exemplary embodiment presented here, which includes four-core electric line 1, only four bushings 2.12 being implemented correspondingly. Alternatively, this contact carrier 2.1 may also be used in cooperation with a six-core electric line. Bushings 2.12 are oriented in parallel to a first direction x. To ensure that extrusion coating 2.2 to be later applied is able to permanently enclose contact carrier 2.1, ribs 2.13 are integrally formed on contact carrier 2.1.

In addition, a collar 2.11 is integrally formed on one-piece, respectively monolithic contact carrier 2.1. As shown in FIG. 7, collar 2.11 has a concave surface 2.111. Concave surface 2.111 is curved about an axis Y that is oriented in parallel to a second direction y. Concave surface 2.111 is spaced, at least regionally, by a radius r from axis Y.

In addition, collar 2.11 has a stop element 2.112 that is spaced at a smaller distance to axis Y than is concave surface 2.111. Stop element 2.112 has, in particular, a surface that is oriented orthogonally to direction y (consequently, the surface in question has a normal vector in parallel to direction y). In addition, ribs 2.113 are provided on contact carrier 2.1.

Figure 8:
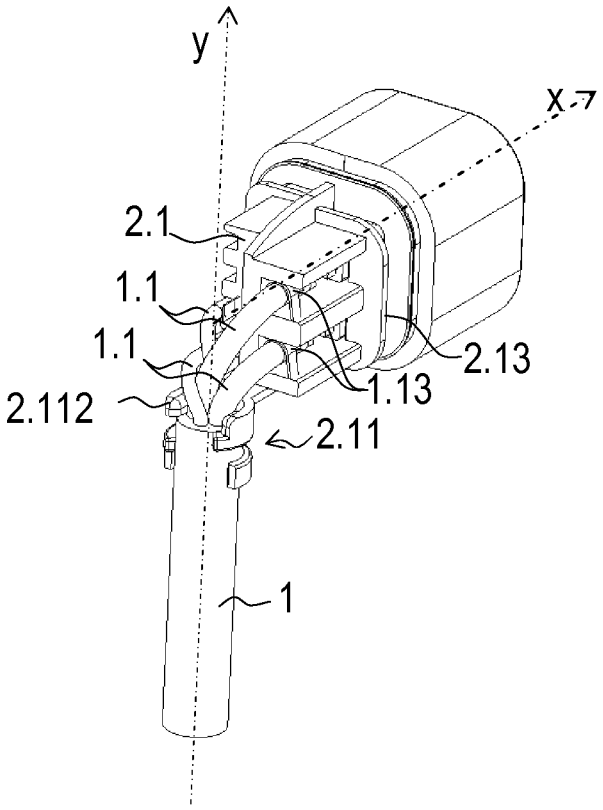
FIG. 8 shows a perspective view of the contact carrier including an installed electric line prior to the extrusion coating.

In the further course of manufacturing of the cable, contacts 1.13 are inserted into contact carrier 2.1, respectively into bushings 2.12, so contacts 1.13 are configured in parallel to first direction x in contact carrier 2.1. Bushings 2.12 are configured to surround contacts 1.13 at least in a partial section that extends along direction x over the circumference thereof (FIG. 8). Thus, contacts 1.13 may be introduced accordingly only from the axial direction (direction x) and not from the radial, respectively tangential direction. This type of construction permits an exceedingly high level of precision with regard to a positionally accurate location of end portions 1.1.

Electric line 1 is then fixed in position to collar 2.11, in particular by clamping. In this context, concave surface 2.111 of collar 2.11 surrounds sheath 1.2. In accordance with FIG. 3, sheath 1.2 has a diameter D that is slightly greater than twice radius r of concave surface 2.111 of collar 2.11 in accordance with FIG. 7. As a result of this dimensional design, electric line 1 is elastically clamped in collar 2.11. This clamping is carried out in accordance with the principle of a clip and may be performed without tools.

In addition, end face-side surface 1.21 of sheath 1.2 rests against stop element 2.1112, respectively against the surface thereof that is oriented orthogonally to direction y, thereby establishing an accurate positioning of electric line 1 relative to contact carrier 2.1. When electric line 1 is fixed in position in this manner, cores 1.1 are elastically deformed by holding forces introduced by collar 2.11 and bent in a way that orients them in parallel to second direction y in the area of collar 2.11. The bending forces of cores 1.11 are intercepted solely by contact carrier 2.1, so that the holding force of collar 2.11 must be at least great enough to allow the bending forces of cores 1.11 to be absorbed.

Electric line 1, which has been fixed with positional accuracy on contact carrier 2.1, is inserted into an extruder. In this context, the special type of construction of electric line 1 and of contact carrier 2.1 ensures that an unwanted, even only slight displacement of electric line 1 relative to contact carrier 2.1 may be virtually ruled out in this manufacturing step (respectively between the manufacturing step of fixing electric line 1 in position and extrusion coating of cores 1.1).

Subsequently thereto, electric line 1 and contact carrier 2.1 are partially extrusion coated with dielectric material (for example, plastic, or with an elastomer), so that collar 2.11, cores 1.1, which are bent by approximately 90°, and the remaining end of sheath 1.2 are surrounded by extrusion coating 2.2. In the exemplary embodiment presented here, the extrusion coated portion of sheath 1.2 extends over a length b (FIG. 3) of 11 mm.

Figure 3:
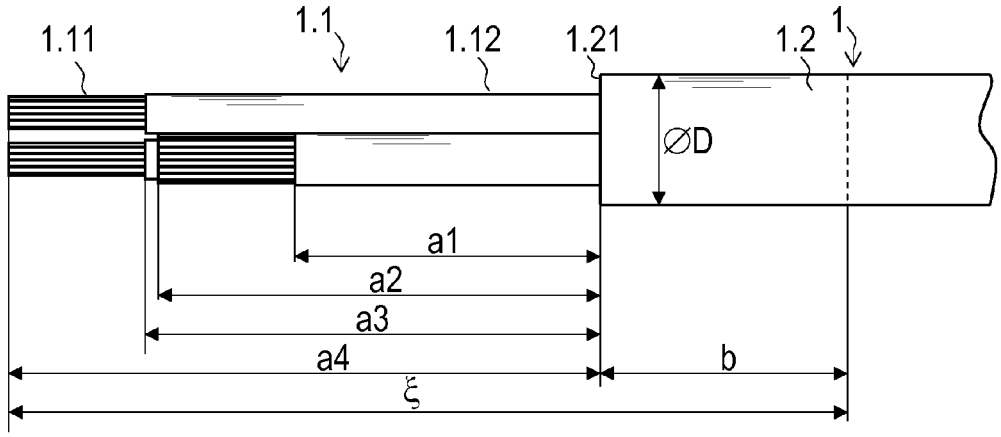
FIG. 3 shows a side view of the electric line in a state during the prefabrication process.

The portion at the end of electric line 1 denoted in FIG. 3 by 4 is completely extrusion coated.

Thus, extrusion coating 2.2 surrounds first regions of cores 1.1, in which the cores extend with a directional component that is oriented in parallel to a first direction x. In addition, extrusion coating 2.2 surrounds second regions of cores 1.1, in which the cores extend with a directional component that is oriented in parallel to a second direction y. The first regions of cores 1.1 are those in which cores 1.1, respectively contacts 1.13 thereof are set into contact carrier 2.1; the second regions of cores 1.1 are those in which electric line 1 is held by collar 2.11 and where the sheath is surrounded by extrusion coating 2.2 (section b in FIG. 3).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A cable comprising:

an electric line having a plurality of cores and an insulating sheath;

contacts attached to ends of the cores;

a plug connector having a contact carrier with an integral design which accommodates the contacts in such a manner that the contacts are disposed in the contact carrier with a directional component that is oriented in parallel to a first direction, the plug connector having an extrusion coating and the cores being at least partially surrounded by the extrusion coating; and a collar integrally formed on the contact carrier, the collar fixing the electrical line in position and bending the cores such that the cores have a directional component that is oriented in parallel to a second direction, the first direction being orthogonal to the second direction, the collar having a stop against which an end side of the insulating sheath abuts.

2. The cable as recited in claim 1, wherein the collar is at least partially surrounded by the extrusion coating.

3. The cable as recited in claim 1, wherein the insulating sheath is removed at an end of the electric line and the cores are surrounded by the extrusion coating over a length of the electric line along which the insulating sheath is removed.

4. The cable as recited in claim 1, wherein the insulating sheath is fixed in position at the collar.

5. The cable as recited in claim 4, wherein the insulating sheath is clampingly fixed in position at the collar.

6. The cable as recited in claim 1, wherein the cores have different lengths.

7. The cable as recited in claim 1, wherein a crimping connects the contacts to the cores.

8. A method for manufacturing a cable having a plug connector, the method comprising:

preparing an electric line having a plurality of cores and an insulating sheath;

attaching contacts to ends of the cores;

inserting the contacts into an integral contact carrier in such a manner that the contacts are disposed in the contact carrier with a directional component that is oriented in parallel to a first direction;

securing the electric line to a collar that is integrally formed on the contact carrier such that the collar bends the cores to have a directional component that is oriented in parallel to a second direction, the first direction being orthogonal to the second direction, the collar having a stop against which an end side of the insulating sheath abuts; and extrusion coating the cores such that the cores are at least partially surrounded by an extrusion coating.

9. The method as recited in claim 8, wherein the extrusion coating is implemented in such a way that the collar is at least partially surrounded by the extrusion coating.

10. The method as recited in claim 8, wherein the contacts are attached to the ends of the cores using a crimping process.

11. The method as recited in claim 8, wherein the insulating sheath is removed at an end of the electric line such that an end face-side surface of the insulating sheath is produced at the end side and used as a reference for a cutting-to-length of the cores.

12. The method as recited in claim 8, wherein the cores have different lengths.

* * * * *